US006470600B1

(12) United States Patent
Louie

(10) Patent No.: US 6,470,600 B1
(45) Date of Patent: Oct. 29, 2002

(54) MARTIAL ARTS SHOE

(76) Inventor: Timothy Louie, 1292 Green, San Francisco, CA (US) 94109

( * ) Notice: Subject to any disclaimer, the term of this patent is extended or adjusted under 35 U.S.C. 154(b) by 0 days.

(21) Appl. No.: 09/873,152

(22) Filed: Jun. 1, 2001

(51) Int. Cl.[7] ..... A43B 5/00

(52) U.S. Cl. ..... 36/113; 36/114; 36/142; 36/59 R

(58) Field of Search ..... 36/113, 114, 25 R, 36/71, 142, 143, 144, 59 R, 59 C, 102, 32 R, 30 R, 31, 88, 92, 69, 45

(56) References Cited

U.S. PATENT DOCUMENTS

| | | | | | |
|---|---|---|---|---|---|
| 1,726,198 | A | | 8/1929 | Stahl | |
| 3,667,140 | A | | 6/1972 | Hunderford | |
| 4,045,888 | A | * | 9/1977 | Oxenberg | 36/114 |
| 4,051,613 | A | | 10/1977 | Collins | |
| 4,361,912 | A | | 12/1982 | Arthur | |
| 4,361,970 | A | | 12/1982 | Wren, Jr. et al. | |
| 4,389,798 | A | * | 6/1983 | Tilles | 36/129 |
| 4,397,105 | A | | 8/1983 | Richardson | |
| 4,495,715 | A | | 1/1985 | Fredrickson et al. | |
| 4,559,722 | A | * | 12/1985 | Norton | 36/105 |
| 4,624,015 | A | | 11/1986 | Bottoms | |
| 4,689,898 | A | * | 9/1987 | Fahey | 36/144 |
| 4,769,854 | A | | 9/1988 | Williams | |
| 4,769,928 | A | * | 9/1988 | Ward | 36/114 |
| 4,845,862 | A | * | 7/1989 | Phillips et al. | 36/4 |
| 4,854,055 | A | * | 8/1989 | Sugiyama et al. | 36/127 |
| 5,295,314 | A | * | 3/1994 | Moumdijian | 36/107 |
| D397,841 | S | | 9/1998 | Munns | |
| 5,848,484 | A | * | 12/1998 | Dupree et al. | 36/100 |
| 5,918,383 | A | * | 7/1999 | Chee | 36/28 |
| 5,921,004 | A | * | 7/1999 | Lyden | 36/114 |
| 6,108,943 | A | * | 8/2000 | Hudson et al. | 36/102 |
| D436,244 | S | | 1/2001 | James | |

OTHER PUBLICATIONS

Web page at martialartsmart.com showing martial arts shoes. 1 pages.
Web pages at gungfu.com showing martial arts shoes. 10 pages.
Conflux martial arts shoe ad in Dec. 1984 issue of Inside Kung–Fu magazine. 2 pages.

* cited by examiner

*Primary Examiner*—M. D. Patterson
(74) *Attorney, Agent, or Firm*—Jack Lo

(57) ABSTRACT

The martial arts shoe is comprised of a sole and an upper attached thereon. The sole has a raised rim. A rib is attached to the sole on an outer side of the shoe for providing better grip and for protecting the outer edge of the foot. A rigid insert is embedded in the rim for additional protection. The rim has gaps on the sides near the front to enable a toe portion of the sole to bend back more fully for front kicks. A tread pattern on the bottom of the sole includes suction cups along the outer edge for grip, transverse grooves at the toe area for grip, longitudinal grooves behind the toe area for fore and aft sliding, and concentric circular grooves at the ball and heel areas for pivoting.

5 Claims, 4 Drawing Sheets

MARTIAL ARTS SHOE

BACKGROUND OF THE INVENTION

1. Field of the Invention

This invention relates generally to shoes.

2. Prior Arts

Many martial arts involve a great deal of kicking. A practitioner typically strikes with the outer edge of the foot when executing a side kick, the ball of the foot when executing a front kick, and the top of the foot when executing a front sweeping kick. The outer edge of the foot is also used extensively for gripping the ground in stances. Therefore, the martial arts practitioner needs a shoe that is very different from those used for other sports.

Protective foot wear specifically designed for martial arts is known. For example, U.S. Pat. No. 4,769,854 to Williams discloses a simple foot wrap. The toes and heel are exposed. U.S. Pat. No. 4,624,015 to Bottoms discloses a boot with evenly thick padding all around that does not protect any specific areas. U.S. Pat. No. 4,495,715 to Fredrickson et al. discloses a toe cap that leaves the rest of the foot unprotected. U.S. Pat. No. 4,397,105 to Richardson; U.S. Pat. No. 4,361,970 to Wren, Jr. et al.; and U.S. Pat. No. 4,361,912 to Arthur each disclose a thickly padded foot cover, but lack a sole for protecting the bottom of the foot. U.S. Pat. No. 4,051,613 to Collins discloses a shoe with an especially thickened toe cap, but the rest of the shoe is relatively thinly padded.

The outer edge of the foot takes a beating when performing side kicks, but prior arts shoes provide inadequate protection. In a front kick, the toes must bend up to strike with the ball of the foot, but prior arts shoes with thick soles prevent the toes from more fully bending up, whereas those with thin soles provide inadequate shock absorption. None of the prior arts shoes are particularly suitable for protecting the martial arts practitioner in his or her specialized activities.

OBJECTIVES OF THE INVENTION

The objectives of the present martial arts shoe are:

to provide better grip in martial arts stances;

to protect the outer edge, toes, and upper parts of the foot when kicking;

to allow the toes to bend back more fully for executing front kicks;

to prevent sideways sliding on the floor, but allowing fore and aft sliding, and rotation about the ball and heel; and to allow the foot to more easily extend and point.

Further objectives of the present invention will become apparent from a consideration of the drawings and ensuing description.

BRIEF SUMMARY OF THE INVENTION

The martial arts shoe is comprised of a sole and an upper attached thereon. The sole has a raised rim. A rib is attached to the sole on an outer side of the shoe for providing better grip and for protecting the outer edge of the foot. A rigid insert is embedded in the rim for additional protection. The rim has gaps on the sides near the front to enable a toe portion of the sole to bend back more fully for front kicks. A tread pattern on the bottom of the sole includes suction cups along the outer edge for grip, transverse grooves at the toe area for grip, longitudinal grooves behind the toe area for fore and aft sliding, and concentric circular grooves at the ball and heel areas for pivoting.

DETAILED DESCRIPTION OF THE INVENTION

FIGS. 1–5

Figure 1:
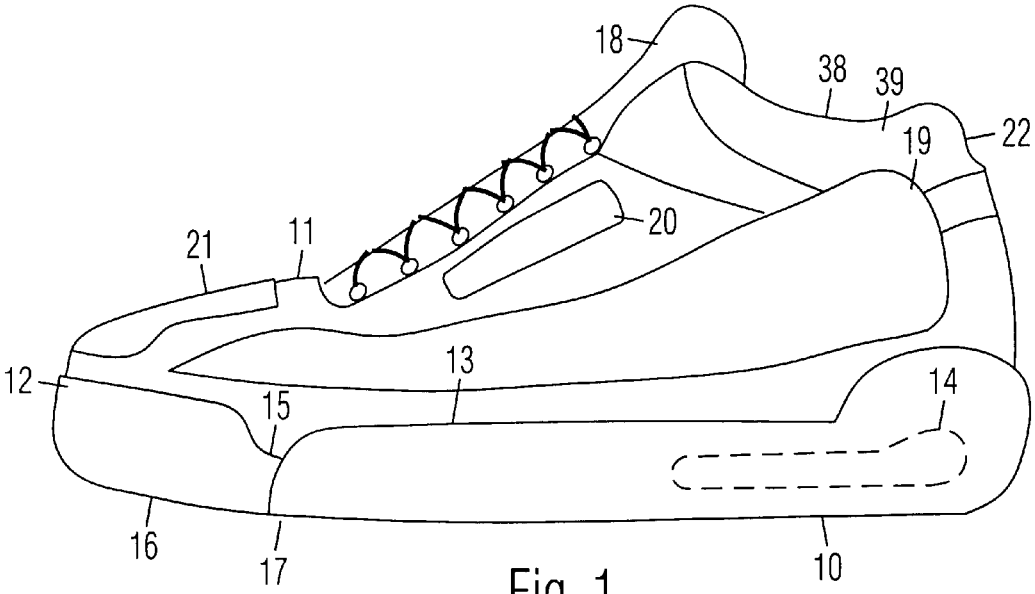
FIG. 1 is side view of the present martial arts shoe.
Figure 2:
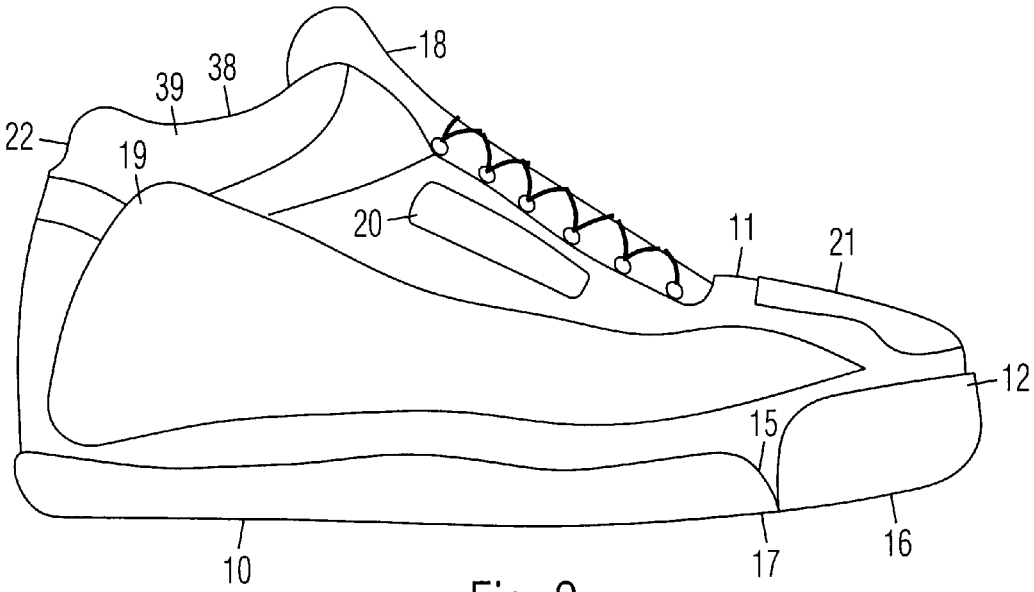
FIG. 2 is an inner side view thereof.
Figure 3:
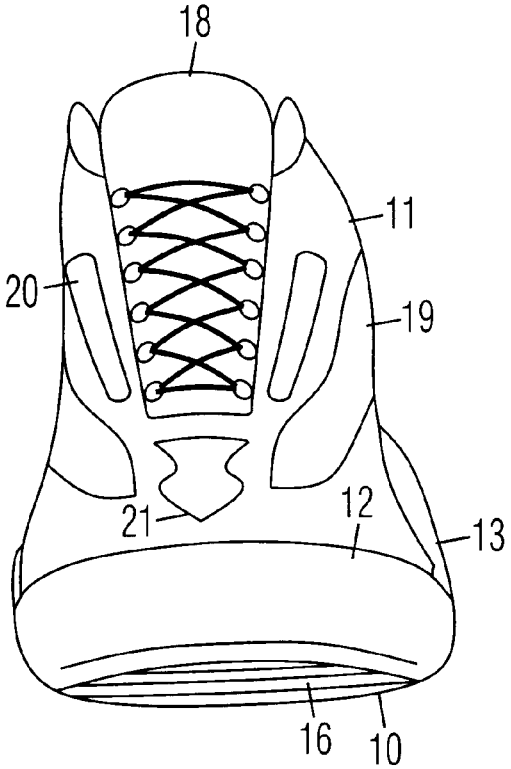
FIG. 3 is a frony view thereof.
Figure 4:
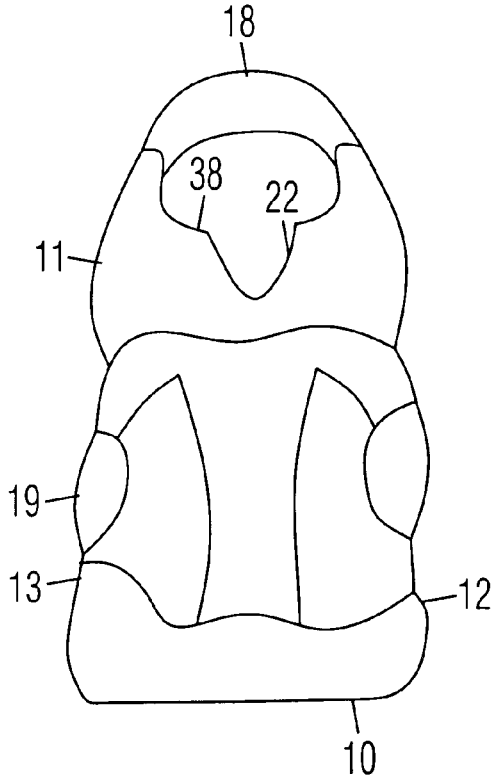
FIG. 4 is a rear view thereof.
Figure 5:
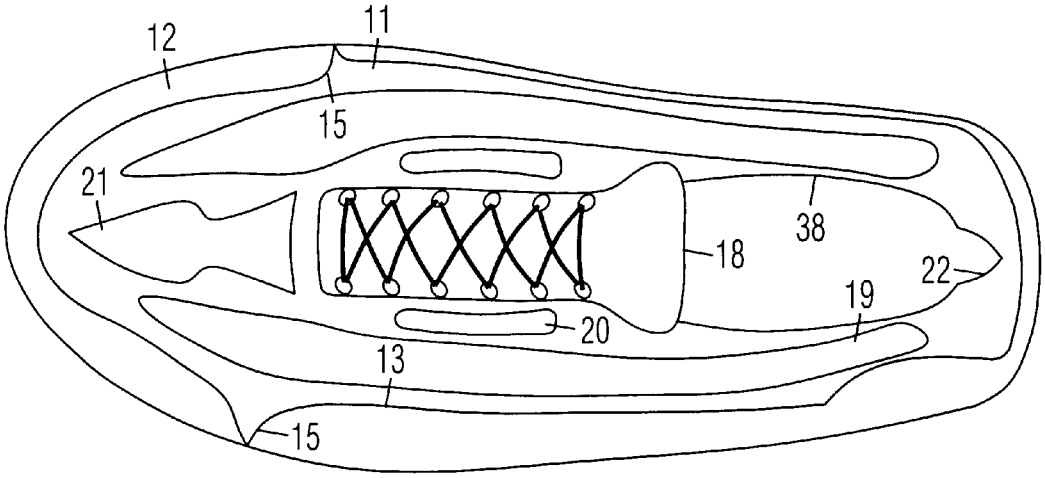
FIG. 5 is a top view thereof.

A preferred embodiment of the present martial arts shoe is shown in FIGS. 1–5 in outer side, inner side, front, rear, and top views, respectively. The example shown is a left shoe; a right shoe would be a mirror image thereof. It is comprised of a sole 10 which is preferably made of rubber or any other suitably resilient material. An upper 11 is attached on top of sole 10, and is preferably made of a fabric material or any other suitably flexible material. A raised rim 12 is provided along the periphery of sole 10 for protecting opposite sides of the foot. Rim 12 may entirely encircle sole 10, or it may extend only along selected parts of it. An integral rib 13 is provided on sole 10 on the outer side of the shoe for sturdiness and improved grip when in martial arts stances, and for protecting the outer edge of the foot when executing side kicks. Rib 13 is preferably about twice as high as sole 10, and substantially taller and thicker than rim 12 on the inner side of the shoe for providing adequate protection to the outer edge of the foot. A relatively rigid insert 14 is embedded in rib 13 for additional protection. Rim 12 has notches 15 on the sides of the shoe near the front to enable a toe portion 16 of sole 10 to bend back more fully and expose a ball portion 17 of sole 10 for executing front kicks.

A tongue 18 inside an opening 38 of upper 11 is especially thickened for absorbing impacts when executing sweeping front kicks. Resilient pads 19–21 are respectively provided on the upper sides, lower sides and top of upper for protecting other areas of the-foot. A resilient pad 39 is also provided around opening 38. The resilient pads may be filled with any suitable shock absorbing material, such as fiber, gel, etc. A cutout 22 is provided on the rear of opening 38 of upper 11 to provide clearance for the back of the lower leg and thus enable the foot to point and extend, that is, to align with the lower leg.

FIG. 6

Figure 6:
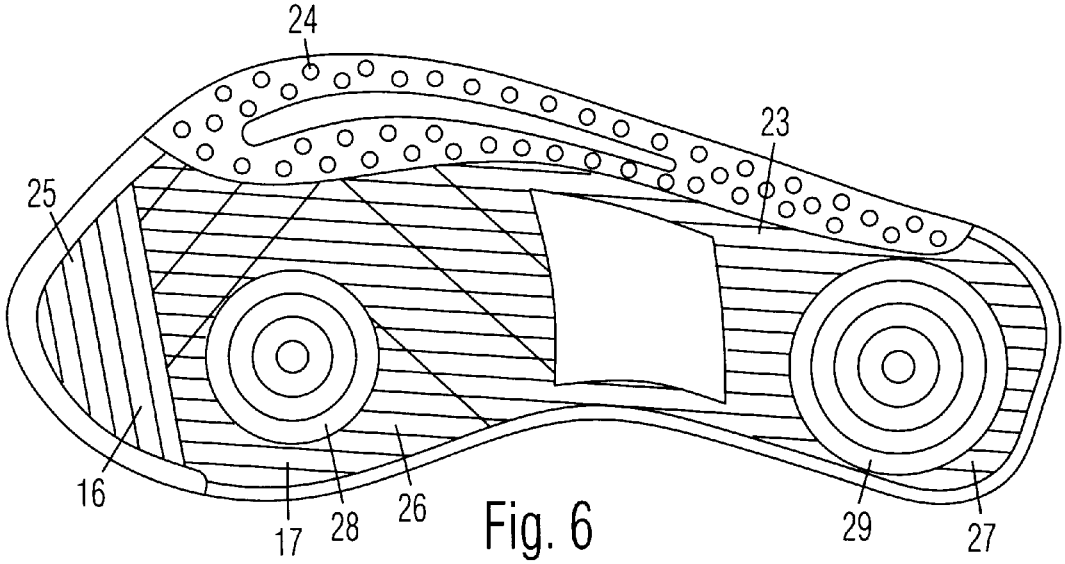
FIG. 6 is a bottom view thereof.

As shown in FIG. 6, a tread pattern 23 on the bottom of sole 10 includes suction cups 24 along the outer edge for grip in a lateral direction in martial arts stances, transverse grooves 25 at toe portion 16 for grip in a longitudinal direction when standing on toe portion 16, longitudinal grooves 26 extending from behind toe portion 16 to a heel portion 27 for facilitating fore and aft sliding, and concentric circular grooves 28 and 29 respectively at ball portion 16 and heel portion 27 for pivoting on one foot at either the ball or the heel.

FIG. 7

Figure 7:
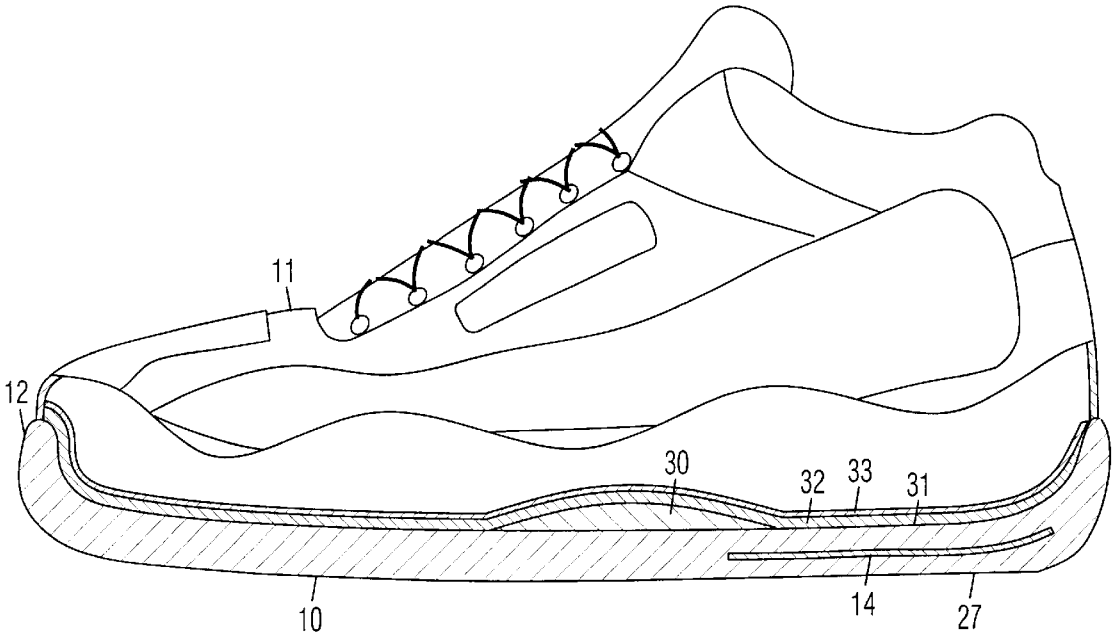
FIG. 7 is a side partial cutaway view thereof.

A partial cutaway side view of the martial arts shoe is shown in FIG. 7. The front of rim 12 on sole 10 is arranged to protect the toes when executing a front kick. A relatively high density foam arch 30 is provided at an intermediate position on top of an insole 31 for additional cushioning when in martial arts stances or executing side kicks. The remaining area of insole 31 is lined with a lower density foam pad 32, and a fabric mesh 33 is attached on top of foam pad 32. Fabric mesh 33 may be nylon or cloth. Foam pad 32 is preferably about ⅛" thick for adequate cushioning. Insert 14 is positioned in heel portion 27 of sole 10.

FIG. 8

Figure 8:
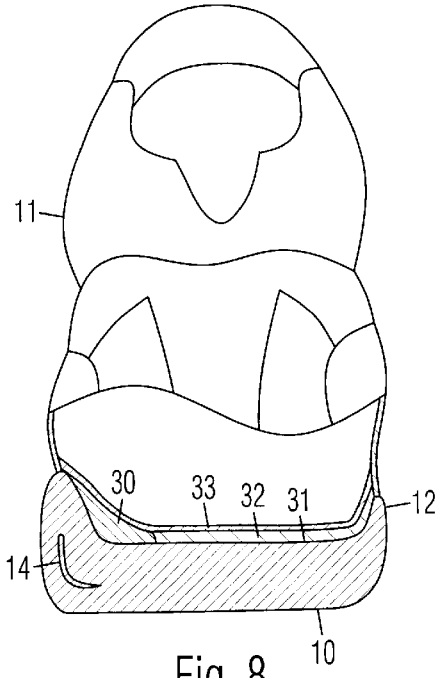
FIG. 8 is a rear partial cutaway view thereof.

A partial cutaway rear view of the martial arts shoe is shown in FIG. 8. Foam arch 30 is positioned toward the outer portion of sole 10 for especially cushioning the outer edge of the foot when in stances or executing side kicks. It is substantially thicker than foam pad 32. As shown in FIG. 8, insert 14 has an L-shaped cross section for protecting the outer edge of the foot.

FIG. 9

Figure 9:
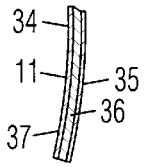
FIG. 9 is a sectional view of a side wall thereof.

An enlarged sectional view of a wall 34 of upper 11 is shown in FIG. 9. It is preferably comprised of a leather outer layer 35, a synthetic fiberfill core 36, and a nylon mesh inner layer 37.

Summary and Scope

Accordingly, the present martial arts shoe provides better grip in martial arts stances. It protects the outer edge, toes, and upper parts of the foot when kicking. It allows the toes to bend back more fully for executing front kicks. It prevents sideways sliding on the floor when in stances, but allows fore and aft sliding, and rotation on one foot about the ball or heel. It also allows the foot to more easily extend and point.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. The shoe can be used for other sports and activities. Therefore, the scope of the invention should be determined by the appended claims and their legal equivalents, not by the examples given.

I claim:

1. A shoe, comprising:

an elongated sole with an insole and a bottom surface;

an upper attached on top of said sole and having an opening for receiving a foot;

a longitudinal rib attached to said sole on an outer side of said shoe for improved grip in stances and for protecting an outer edge of the foot, wherein said rib is substantially taller than a portion of said sole on an inner side of said shoe for increased strength; and a tread pattern on said bottom surface of said sole comprising suction cups along an outer edge of said sole for improving grip in a lateral direction, transverse grooves at a toe portion of said sole for improving grip along a longitudinal direction, longitudinal grooves extending from behind said toe portion to a heel portion of said sole for facilitating fore and aft sliding, and concentric circular grooves at a ball portion and a heel portion of said sole for facilitating pivoting on one foot.

2. A shoe, comprising:

an elongated sole with an insole and a bottom surface;

an upper attached on top of said sole and having an opening for receiving a foot;

a raised rim along a periphery of said sole for protecting opposite edges of the foot;

a longitudinal rib attached to said sole on an outer side of said shoe for improved grip in stances and for protecting an outer edge of the foot, wherein said rib is substantially taller than said rim on an inner side of said sole for increased strength;

a pair of notches in said rim on opposite sides of said shoe immediately behind a toe portion of said sole to enable said toe portion to bend back more fully and expose a ball portion of said sole;

a cutout on a rear edge of said opening of said upper to provide clearance for a back of a lower leg when the foot is extended to align with the lower leg; and a tread pattern on said bottom surface of said sole comprising suction cups along an outer edge of said sole for improving grip in a lateral direction, transverse grooves at a toe portion of said sole for improving grip along a longitudinal direction, longitudinal grooves extending from behind said toe portion to a heel portion of said sole for facilitating fore and aft sliding, and concentric circular grooves at a ball portion and a heel portion of said sole for facilitating pivoting on one foot.

3. A shoe, comprising:

an elongated sole with an insole and a bottom surface;

an upper attached on top of said sole and having an opening for receiving a foot;

a raised rim along a periphery of said sole for protecting opposite edges of the foot;

an integral rib attached to said sole on an outer side of said shoe for improved grip in stances and for protecting an outer edge of the foot, wherein said rib is substantially taller than said rim on an inner side of said shoe for increased strength;

a pair of notches in said rim on opposite sides of said shoe immediately behind a toe portion of said sole to enable said toe portion to bend back more fully and expose a ball portion of said sole;

a cutout on a rear edge of said opening of said upper to provide clearance for a back of a lower leg when the foot is extended to align with the lower leg;

a tread pattern on said bottom of said sole comprising suction cups along an outer edge of said sole for improving grip in a lateral direction, transverse grooves near said toe portion for improving grip along a longitudinal direction, longitudinal grooves extending from behind said toe portion to a heel portion of said sole for facilitating fore and aft sliding, and concentric circular grooves at a ball portion and said heel portion of said sole for facilitating pivoting on one foot;

resilient pads arranged on said upper for protecting other areas of the foot;

a higher density foam arch arranged on said insole near an outer edge thereof for additional cushioning to the outer edge of the foot; and a lower density foam pad lining a remaining area of said insole, and a fabric mesh attached on top of said foam pad.

4. The shoe of claim 3, further including a generally rigid insert embedded in said rib for additional strength.

5. The shoe of claim 3, wherein said upper includes a leather outer layer, a nylon mesh inner layer, and a fiberfill core sandwiched between said outer layer and said inner layer.

* * * * *